US008448890B2

(12) United States Patent
Hagleitner

(10) Patent No.: US 8,448,890 B2
(45) Date of Patent: May 28, 2013

(54) PAPER DISPENSER

(76) Inventor: Hans Georg Hagleitner, Zell Am See (AT)

( * ) Notice: Subject to any disclaimer, the term of this patent is extended or adjusted under 35 U.S.C. 154(b) by 56 days.

(21) Appl. No.: 12/940,622

(22) Filed: Nov. 5, 2010

(65) Prior Publication Data

US 2011/0101151 A1 May 5, 2011

Related U.S. Application Data

(63) Continuation of application No. PCT/AT2009/000144, filed on Apr. 10, 2009.

(30) Foreign Application Priority Data

May 5, 2008 (AT) ..... A 706/2008
May 5, 2008 (AT) ..... A 713/2008

(51) Int. Cl.
*B65H 67/04* (2006.01)

(52) U.S. Cl.
USPC ..... 242/560.1; 242/564.4

(58) Field of Classification Search
USPC ..... 242/560, 560.1, 564, 564.3, 564.4
See application file for complete search history.

(56) References Cited

U.S. PATENT DOCUMENTS

| | | | | |
|---|---|---|---|---|
| 3,288,387 | A * | 11/1966 | Craven, Jr. | 242/560.1 |
| 4,165,138 | A | 8/1979 | Hedge et al. | |
| 4,378,912 | A | 4/1983 | Perrin et al. | |
| 4,403,748 | A * | 9/1983 | Cornell | 242/560.1 |
| 4,611,768 | A * | 9/1986 | Voss et al. | 242/564.2 |
| 4,664,304 | A * | 5/1987 | Wendt et al. | 242/564.4 |
| 6,736,348 | B1 | 5/2004 | Formon et al. | |
| 6,826,991 | B1 | 12/2004 | Rasmussen | |
| 7,237,744 | B2 * | 7/2007 | Morris et al. | 242/560.1 |
| 7,354,015 | B2 * | 4/2008 | Byrd et al. | 242/564.1 |
| 2002/0073821 | A1 | 6/2002 | Broehl | |
| 2009/0272836 | A1 * | 11/2009 | Byrd et al. | 242/564.1 |

FOREIGN PATENT DOCUMENTS

| | | | |
|---|---|---|---|
| EP | 1097665 | A2 | 5/2001 |
| WO | 0200083 | A1 | 1/2002 |

* cited by examiner

*Primary Examiner* — William A Rivera
(74) *Attorney, Agent, or Firm* — Laurence A. Greenberg; Werner H. Stemer; Ralph E. Locher

(57) ABSTRACT

A paper dispenser dispenses paper from a dispenser roll lying in a dispensing position. The paper dispenser contains two transport rollers for the web of paper, the rollers defining a gap, and a mobile sensor element for identifying the end of the web of paper. The sensor element being arranged between the two transport rollers downstream of the gap in the direction of transport of the paper.

9 Claims, 6 Drawing Sheets

PAPER DISPENSER

CROSS-REFERENCE TO RELATED APPLICATION

This is a continuation application, under 35 U.S.C. §120, of copending international application No. PCT/AT2009/000144, filed Apr. 10, 2009, which designated the United States; this application also claims the priority, under 35 U.S.C. §119, of Austrian patent application Nos. A 713/2008, filed May 5, 2008, and A 706/2008, filed May 5, 2008; the prior applications are herewith incorporated by reference in their entirety.

BACKGROUND OF THE INVENTION

Field of the Invention

The invention relates to a dispenser for paper from a dispensing reel which lies in a dispensing position. The dispenser has two conveying rolls which define a nip for the paper web and a movable sensing element for detecting the paper end.

In dispensers of this type, the imminent exhaustion of the paper can be indicated with the aid of the sensing element. For example, the sensing element rests loosely on the paper web between the dispensing reel and the conveying rolls, or is pressed against the paper web by a spring. The paper web is wound, for example, onto a cardboard sleeve or a support rod, it being possible for the end to be fixed on the sleeve or on the support rod by gluing; however, it is also optionally wound loosely. The paper end can likewise be loose if the gluing was carried out imprecisely and/or poorly. Since, for example, no precision or complex processing is also to be expected in the case of hygiene papers which are wound on reels, it therefore cannot be ruled out that the sensing element prematurely indicates a lack of paper because of a lack of tension in the paper web near its end, although a few turns are still available. Depending on the type of indication, this can result in unnecessary paper wastage, in particular if the premature detection of a lack of paper triggers the conveying of the paper from a reserve reel.

The invention therefore also relates to a dispenser for paper from a dispensing reel which lies in a dispensing position, which paper can be guided through a nip between two conveying rolls. The dispenser having a receptacle for a reserve reel, a movable holding device which can be assigned the paper start of the reserve reel, and a movable sensing element for the paper end of the dispensing reel. The sensing element releases the holding device for the paper of the reserve reel when the paper end is detected, with the result that the holding device approaches the nip and threads the paper start into the nip.

Dispensers of this type are already known in multiple cases. By nature, the paper paths of the dispensing reel are separated to this end from those of the reserve reel and merge into one another only directly in front of the nip of the two conveying rolls, since automated further paper discharging is to take place after exhaustion of the dispensing reel. The sensing element is therefore assigned to the paper path of the dispensing reel.

In an embodiment known from U.S. Pat. No. 4,165,138, that one of the two conveying rolls which is wrapped around over a majority of its circumference by the paper web of the dispensing reel has a circumferential groove which is assigned the sensing element. When the paper web ends, the sensing element falls into the groove and triggers the approach of the holding device for the paper start of the reserve reel. Here, the sensing element is arranged in such a way that it can remain in the circumferential groove when the paper from the reserve reel is threaded in and conveyed. At some point, the empty reel carrier of the previous dispensing reel can then be removed, the reserve reel which is being used can be moved into the position of the dispensing reel, and a new reserve reel can be inserted. It is necessary here to pivot the sensing element out of the circumferential groove and to activate it for the new dispensing reel by placing it onto the paper web of the reel. Furthermore, it is necessary to pivot the holding device for the paper start of the new reserve reel back into its waiting position and to fix the paper start on the holding device, with the result that the paper dispenser again has a functioning refeeding device when the dispensing reel is empty.

SUMMARY OF THE INVENTION

It is accordingly an object of the invention to provide a paper dispenser which overcomes the above-mentioned disadvantages of the prior art devices of this general type.

With the foregoing and other objects in view there is provided, in accordance with the invention a dispenser for dispensing paper from a dispensing reel which lies in a dispensing position. The dispenser contains two conveying rolls defining a nip for a paper web, and a movable sensing element for detecting a paper end. The sensing element is disposed behind the nip between the two conveying rolls in a paper conveying direction.

The invention has the object of avoiding premature paper end indications in paper dispensers of this type and achieves this by virtue of the fact that the sensing element is arranged behind the nip between the two conveying rolls in the paper conveying direction. As a result of the arrangement of the sensing element behind the nip, the tension is maintained in the paper web despite a loose winding end, since it cannot slide between the conveying rolls. The paper end detection therefore takes place immediately after the conveying of the paper web through the two conveying rolls. Faulty triggering is practically ruled out as a result.

If the dispenser has a reserve reel, the paper start of which is threaded into the nip when the paper end is detected, the space between the reserve reel and the dispensing reel is additionally free as a result of the arrangement of the sensing element behind the nip and the transfer of the reel is not impeded. The sensing element lies at a point, at which it can continue to sense the paper web of the dispensing reel, but does not have to be moved for the change of the reserve reel, since it no longer lies in the path of the changing reserve reel.

There is provision in one preferred embodiment for the two conveying rolls to be arranged substantially above one another and for the lower conveying roll to have a circumferential groove and a substantially greater diameter than the upper conveying roll. Since the lower conveying roll protrudes beyond the upper roll in the width direction, this provides the possibility of the sensing element sensing the paper web of the dispensing reel directly next to the smaller conveying roll, the sensing element falling into the circumferential groove under the influence of gravity when the paper end is detected.

The arrangement of the sensing element outside the space which is required by the reserve reel during the change into the dispensing position permits automation of this change without the service personnel intervening manually. In a preferred embodiment, a restoring element is therefore also provided for this purpose which resets the sensing element into the initial position after the sensing element has detected the paper end. As a result, the paper path behind the nip is opened again after the paper end detection, with the result that the received paper web of the reserve reel can be conveyed without problems. At an instant which is set as desired, the reserve reel can then fall or slide downward without manual help into the dispensing position, from which its paper web is then pulled off further.

In one preferred embodiment, the sensing element is reset by the holding device for the paper start, which holding device is loaded against the nip, by it being possible first of all for the restoring element to be moved into the approaching path of the holding device by the sensing element which moves when the paper end is detected, and by it then being possible for it to be displaced out of the approaching path again by the holding device which approaches the nip, with resetting of the sensing element. This therefore results in a type of kinematic cycle; the sensing element moves when the paper end is detected and releases the holding device which threads in the paper and moves the sensing element back into the initial position again on the path to the nip. Gravity, possibly assisted by a restoring spring, is therefore used to reset the sensing element, and a functionally important step is not made dependent on the skill of the service personnel as a result. As a result, all that remains for the service personnel to do is to raise the holding device, in order to fix the new paper start, for which purpose the holding device is formed in one preferred embodiment by a pivotable hoop, on the transverse web of which mandrels are provided, onto which the paper start can be pressed. The conveying rolls have a slipproof surface, for example rubber rings or the like which reliably detach the pinned paper and pull it into the nip.

In a first embodiment, the sensing element can be pivoted about an axis, and the restoring element can be articulated eccentrically on the sensing element.

There is provision in a second embodiment for the sensing element to be pivotable about an axis and for the restoring element to be formed by a lever which projects on the sensing element and interacts with two stops which are provided on the holding device.

According to the invention, the restoring action of the sensing element can also be provided by the holding device for the paper start of the reserve reel, which holding device approaches the nip, even if the sensing element is provided at a different location on the path of the paper web of the dispensing reel.

Other features which are considered as characteristic for the invention are set forth in the appended claims.

Although the invention is illustrated and described herein as embodied in a paper dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
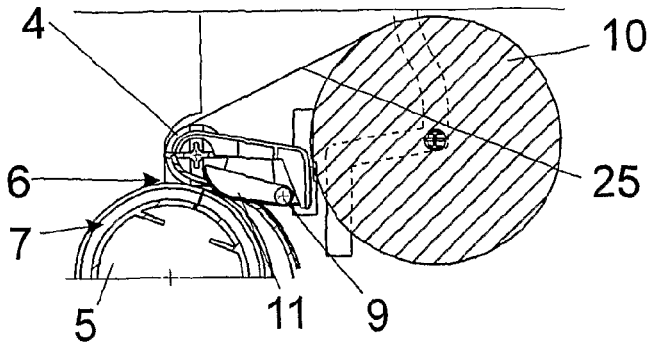
FIG. 1 is a diagrammatic, vertical sectional view through parts of a paper dispenser with a dispensing reel according to the invention.
Figure 2:
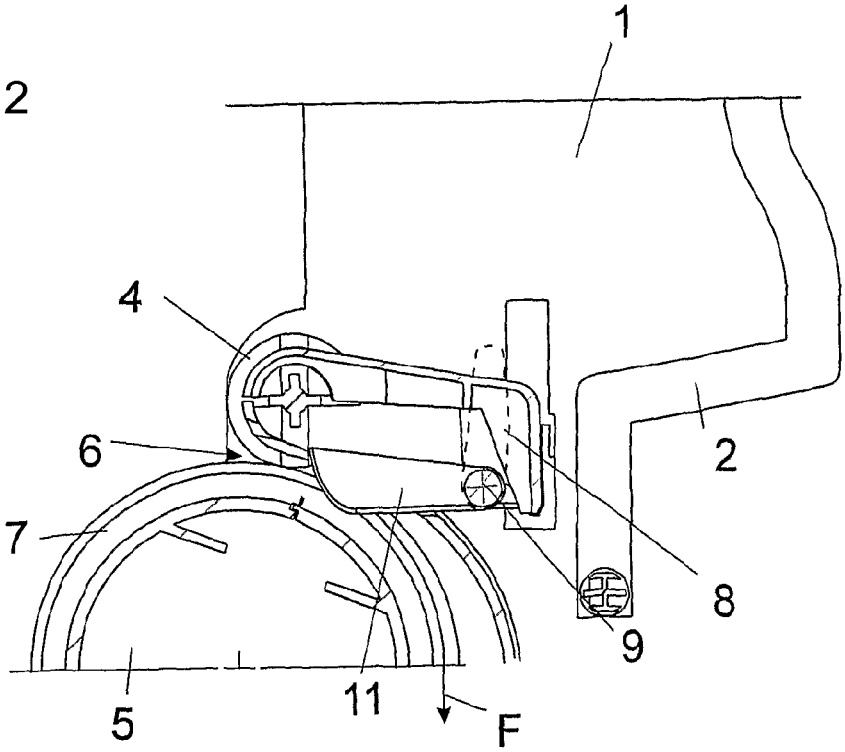
FIG. 2 is a diagrammatic, enlarged vertical sectional view according to FIG. 1 after a detection of a lack of paper.
Figure 3:
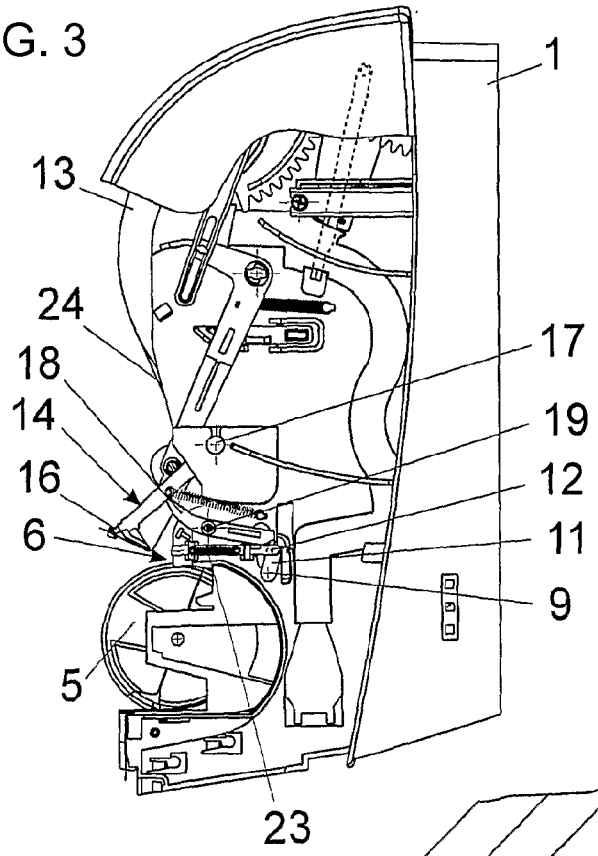
FIG. 3 is a diagrammatic, side view of the paper dispenser with a removed cover panel.

Referring now to the figures of the drawing in detail and first, particularly, to FIGS. 1 and 2 thereof, there is shown a paper dispenser that has a housing, in a lower region of which a receiving space for a dispensing reel 10 and a conveying roll pair 4, 5 which contains a knife arrangement are arranged. The conveying roll pair 4, 5 can be driven manually by pulling on the paper, by an external crank or preferably in a sensor controlled manner by an electric motor. The conveying roll pair has a smaller conveying roll 4 in the embodiment shown, over which conveying roll 4 a paper web 25 of the dispensing reel 10 is guided into the nip 6 with the second larger conveying roll 5 which is mounted below the conveying roll 4 and can contain the knife arrangement.

The second conveying roll 5 has a circumferential groove 7 which is assigned a sensing element 11 which is mounted behind the nip 6 in the conveying direction F such that it can be pivoted about an axis 9. The sensing element 11 can be provided with a bracket 8 which lies upright at an angle, is indicated only diagrammatically in FIG. 2 and via which the resetting of the sensing element 11 can take place into the position shown in FIG. 1.

A paper dispenser according to FIGS. 3 to 9 has a housing 1 which is provided with a non-illustrated cover panel which can be pivoted up. Here too, a receiving space for a dispensing reel 10 and a conveying roll pair which contains, in particular, a knife arrangement are arranged in the lower region of the dispenser, which conveying roll pair is driven manually by pulling on the paper, by an external crank or preferably in a sensor controlled manner by an electric motor.

The second conveying roll 5 has a circumferential groove 7 which is assigned a sensing element 11 which is mounted behind the nip 6 in the conveying direction such that it can be pivoted about an axis 9. The sensing element 11 is provided with a control bracket 8 which lies upright at an angle and by which the movement of the sensing element 11 is transferred during entry into the circumferential groove 7.

After the insertion of the reel into an upper receiving space, a paper start 24 of the reserve reel 13 is fixed on mandrels 16 of a holding device 14 which is formed by a hoop which can be pivoted about an axis 17, and is held at a spacing from the nip 6 between the conveying rolls 4, 5 by a latching lever 18 which can be pivoted about an axis 19. The front end of the latching lever 18 lies on a projection 22 (FIGS. 7, 8) of a side part of the holding device 14, and the rear end rests with an inclined slope 21 (FIGS. 7, 8) on the control bracket 8 of the sensing element 11. Furthermore, the side part of the holding device 14 carries a lug 20 which, during approach to the nip 6, comes into contact with the spring loaded restoring element 12 which is configured in the form of a slide and the other end of which is articulated on the control bracket 8 of the sensing element 11.

Figure 4:
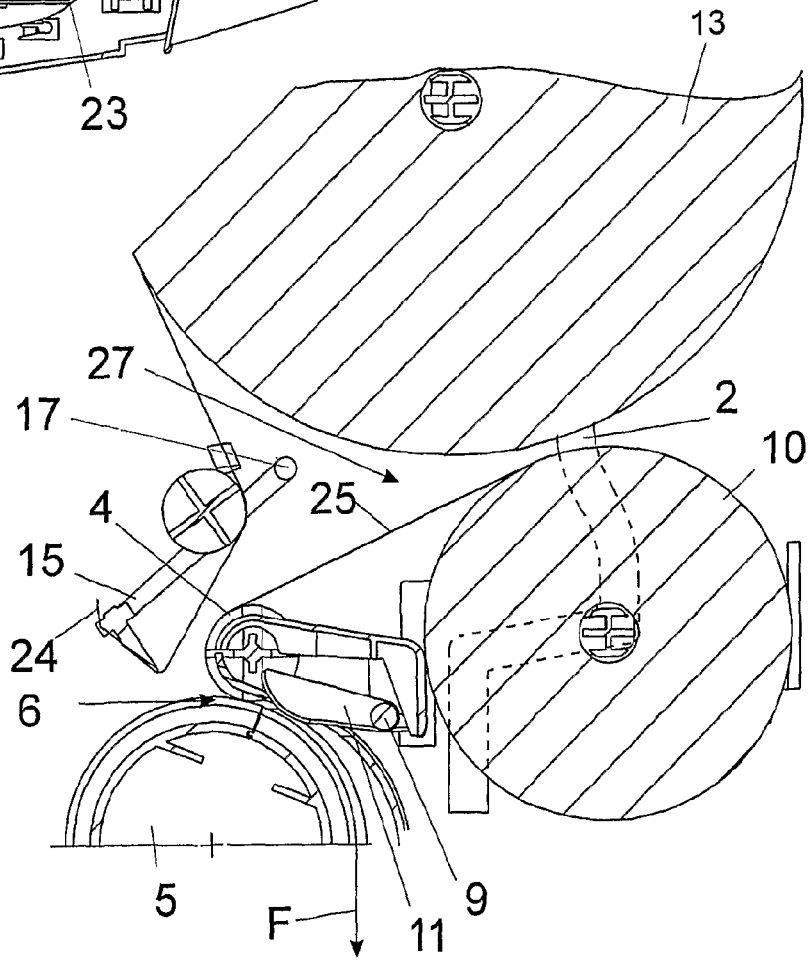
FIG. 4 is a diagrammatic, vertical sectional view through a center region of the dispenser from FIG. 3.
Figure 8:
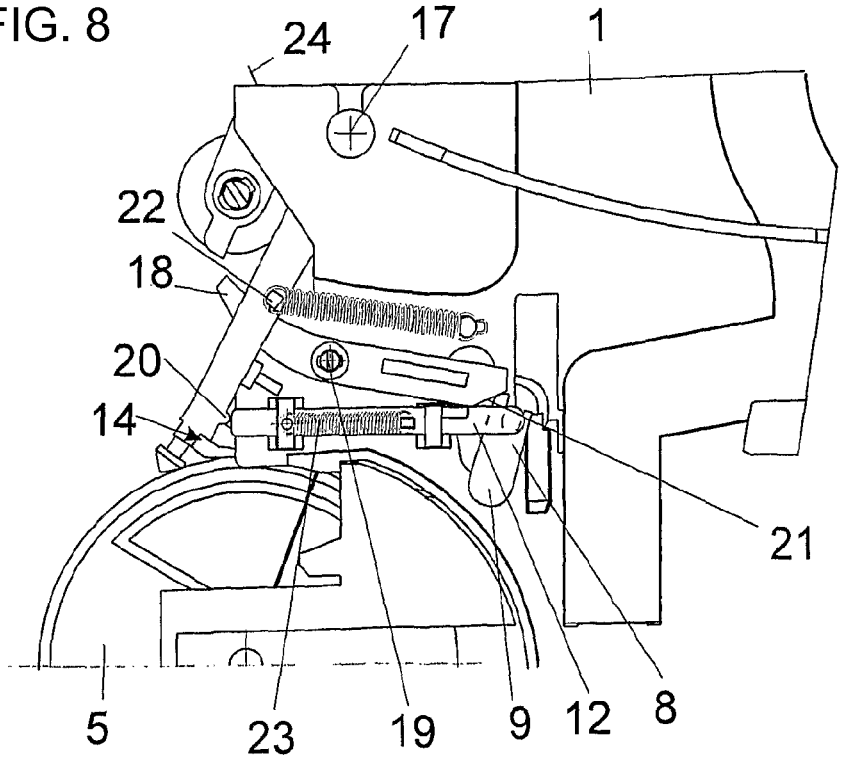
Figure 9:
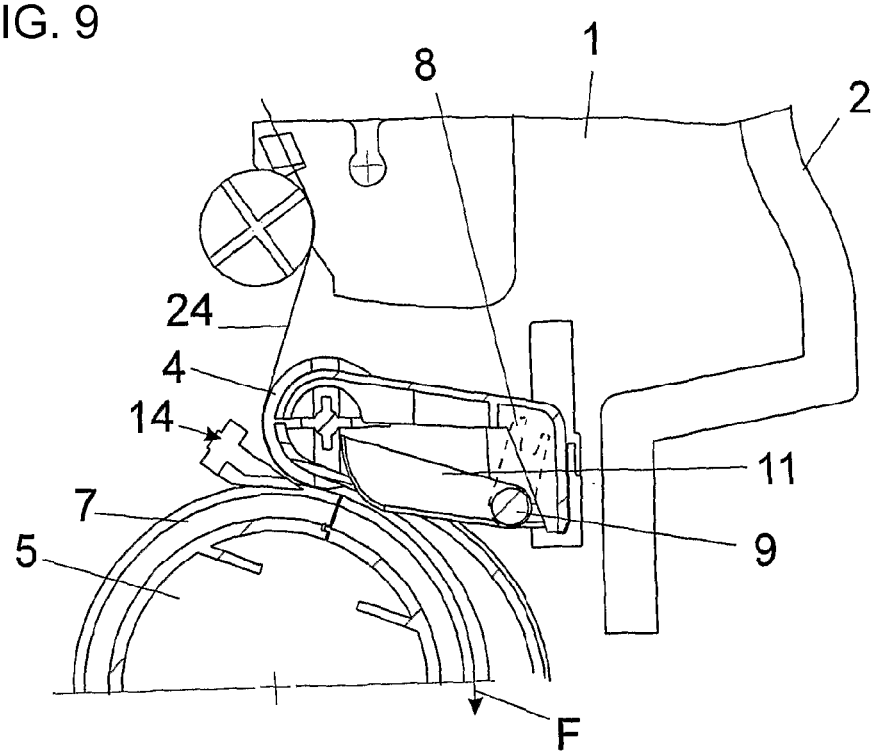

The function will now be explained in greater detail with reference to FIGS. 4 to 9: as can be seen from FIG. 4, the paper web 25 from the dispensing reel 10 is guided over the conveying roll 4 through the nip 6 and over the conveying roll 5, the sensing element 11 resting on the paper web 25 behind the nip 6. If the paper is finished, the sensing element 11 falls into the circumferential groove 7 of the conveying roll 5 (FIG. 5) under the action of gravity and assisted by the spring 23 which is assigned to the restoring element 12. Here, the upright control bracket 8 pivots forward (to the left in the drawing), pushes the restoring element 12 forward with the assistance of the spring 23 and presses the rear end of the double armed latching lever 18 upward, the front end of which latching lever 18 slides off from the projection 22 on the side part of the holding device 14. The holding device 14 can therefore pivot about the axis 17 as a result of gravity and assisted by the tension spring shown, with the result that the wedge-shaped threading lug of the transverse web 15 of the holding device 14 approaches the nip 6 with the paper start of the reserve reel 13 attached to it. Before the nip 6 is reached, the lug 20 comes into contact with the advanced restoring element 12 and pushes the latter back into the starting position (FIGS. 6, 8) again. Since the restoring element 12 is articulated on the control bracket 8, the latter pivots backward (to the right in the drawing) and raises the sensing element 11 out of the circumferential groove 7 of the conveying roll 5. As soon as the threading lug of the transverse web 15 has reached the nip 6, the paper start 24 is gripped by the surface of the two conveying rolls which has, in particular, a rubber coating at least in regions, is detached from the mandrels 16 and is pulled into the nip. The further path for the paper web 24 is free thanks to the resetting of the sensing element 11. FIGS. 8 and 9 show these positions in a side view and in cross section.

Figure 5:
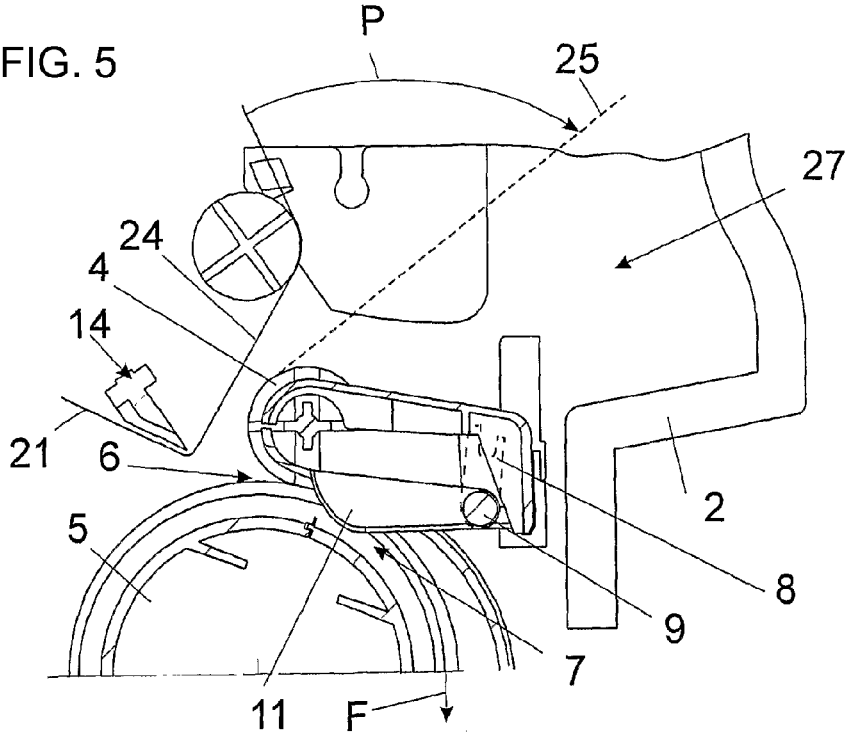
FIGS. 5 to 9 are diagrammatic, side views showing different positions of components which are important to the invention.
Figure 6:
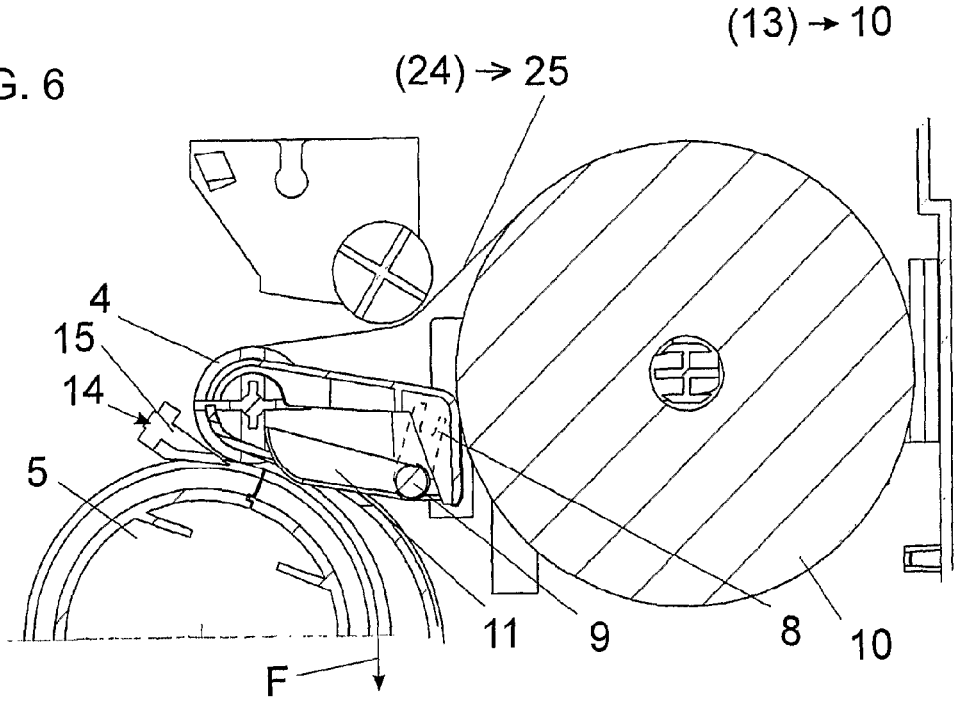
Figure 7:
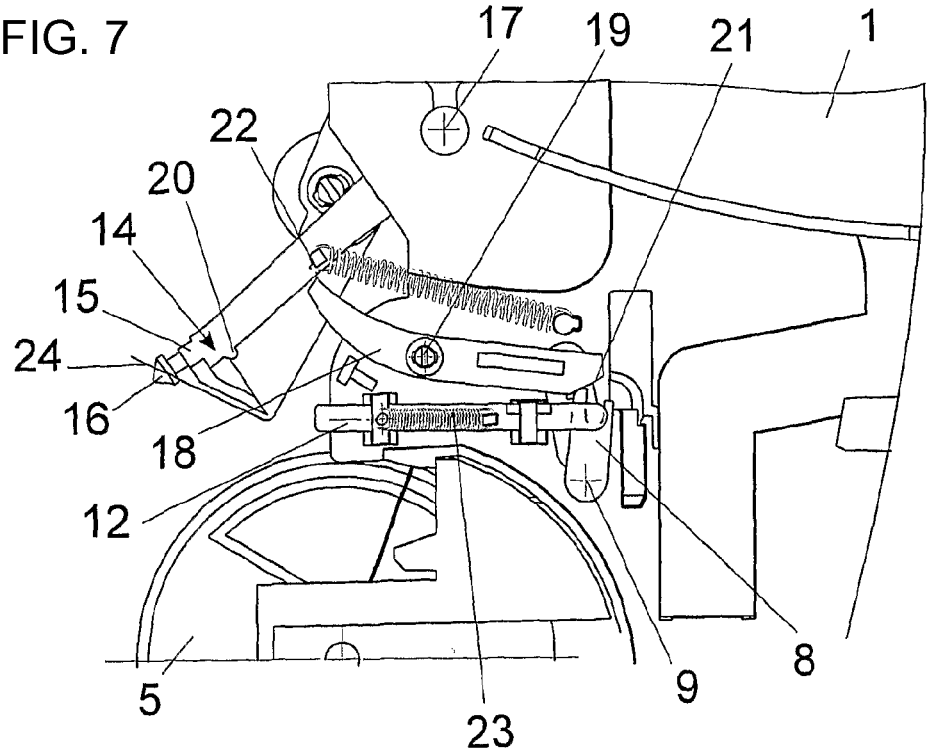

After a defined service time, the diameter of the reserve reel 13 has been reduced to such an extent that it can fall or slide along the guide track 2 out of the waiting position downward into the receiving space (FIG. 6). Since there are no disruptive fixtures in the transfer region 27 (FIGS. 4, 5) and the sensing element 11 which is required for the paper web 25 lies on the outside, this change can take place without the assistance of a service person. FIG. 5 shows the region P, in which the paper web is moved from 24 to 25. The automatic change can take place, for example, by diameter sensing of the reserve reel 13 in the upper position, which reserve reel 13 then falls or slides downward in the guide track 2 in the case of a correspondingly reduced diameter.

Figure 10:
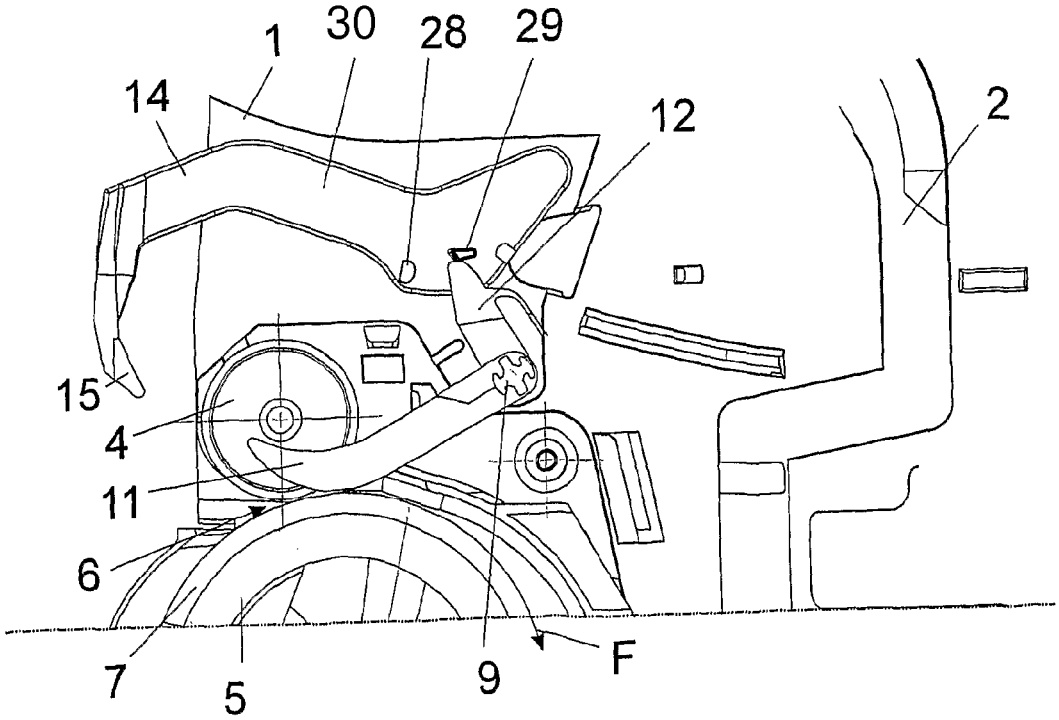
FIGS. 10 to 12 are diagrammatic, side views showing different positions of components which are important to the invention, in a further embodiment.
Figure 11:
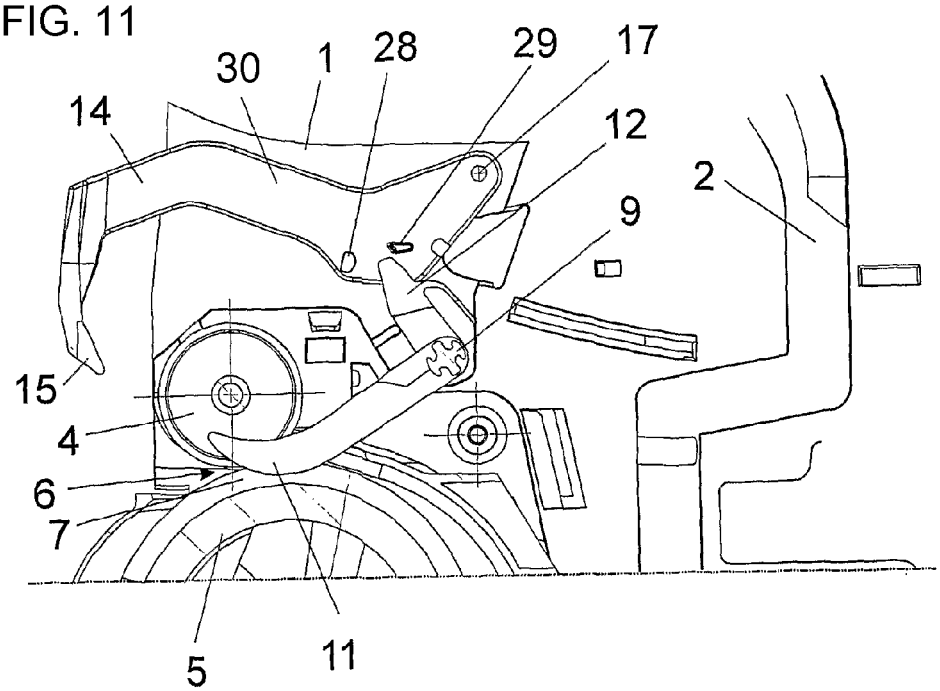
Figure 12:
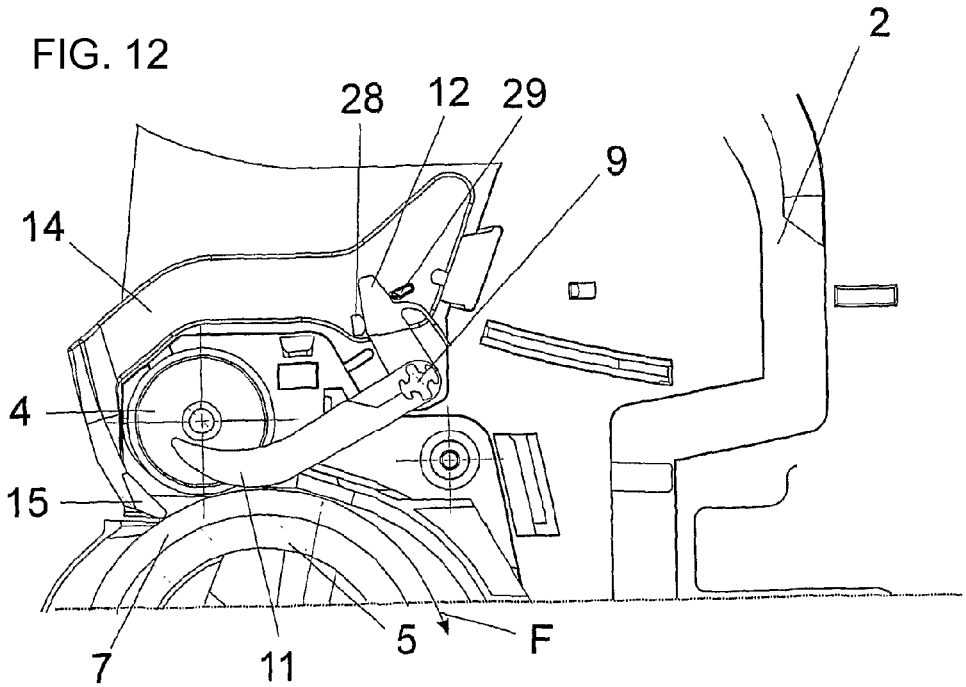

FIGS. 10 to 12 show essential parts of a third embodiment of the dispenser 1. The two conveying rolls 4, 5 which delimit the nip 6 are shown, of which the larger conveying roll contains a knife arrangement which cuts the paper web into sections. The sensing element 11 is mounted such that it can be rotated about the axis 9 and falls into the circumferential groove 7 of the conveying roll at the end of the paper web (not shown in FIGS. 10 to 12). It is also the case in this embodiment that the paper web is sensed behind the nip 6 in the paper conveying direction F.

The holding device 14 for the start of the paper web of the reserve reel is configured in the manner of a hoop as described. Two stops 28 and 29 are formed on at least one side part 30 of the holding device 14. In the waiting position shown in FIG. 10, the side part 30 rests on the restoring element 12 which projects upright from the sensing element 11, and the transverse web 15 is held at a spacing from the nip 6. As soon as the paper end of the dispensing reel 10 is detected, the sensing element 11 falls into the circumferential groove 7 and the restoring element 12 pivots forward or to the left in FIG. 10.

As a result, the holding device 14 is released (FIG. 11) and pivots downward about the axis 17, the second stop 28 coming into contact with the restoring element 12 shortly after the triggering, with the result that the restoring element 12 is pivoted back after conclusion of the pivoting movement of the holding device 14 and, as a result, the sensing element 11 is raised out of the circumferential groove 7 again (FIG. 12). As a result, the path for the paper web of the reserve reel is free again, which paper web is threaded in by the holding device 14.

During insertion of a new reserve reel, the holding device 14 is pivoted up again out of the position according to FIG. 12, with the result that the end of the restoring element 12 comes to lie under the stop 29 again. The free end of the restoring element 12 is resilient perpendicularly with respect to the plane of the drawing, with the result that it can evade the stop 29 during the return pivoting movement.

The invention claimed is:

1. A dispenser for dispensing paper from a dispensing reel which lies in a dispensing position, the dispenser comprising:

two conveying rolls defining a nip for a paper web, wherein the paper web arrives on an upstream side of said conveying rolls, travels through said nip, and issues on a downstream side of said conveying rolls in a paper conveying direction; and a movable sensing element for detecting a paper end, said sensing element being disposed downstream of said nip in the paper conveying direction.

2. The dispenser according to claim 1, wherein said two conveying rolls are disposed substantially above one another.

3. The dispenser according to claim 2, wherein said two conveying rolls include a lower conveying roll having a circumferential groove formed therein and a substantially greater diameter than an upper conveying roll.

4. The dispenser according to claim 3, wherein said sensing element presses on said lower conveying roll under an influence of gravity and falls into said circumferential groove when the paper end is detected.

5. The dispenser according to claim 1, further comprising a restoring element for resetting said sensing element into an initial position after said movable sensing element has detected the paper end.

6. The dispenser according to claim 5, further comprising:

a receptacle for a reserve reel; and a holding device loaded against the nip and can be assigned a paper start of the reserve reel, said movable sensing element releasing said holding device when the paper end of the dispensing reel is detected, with a result that said holding device approaches said nip and threads the paper start of the reserve reel into said nip between said two conveying rolls.

7. The dispenser according to claim 6, wherein said restoring element can be moved into an approaching path of said holding device, by means of said movable sensing element which moves when the paper end is detected, and can be displaced out of the approaching path again by said holding device which approaches said nip, with resetting of said movable sensing element.

8. The dispenser according to claim 7, further comprising a projecting control bracket, and said movable sensing element can be pivoted about an axis and said restoring element is articulated on said movable sensing element eccentrically with respect to said axis, on said projecting control bracket.

9. The dispenser according to claim 7, further comprising two stops disposed on said holding device; and wherein said movable sensing element can be pivoted about an axis and said restoring element is formed by a lever which projects on said movable sensing element and interacts with said two stops disposed on said holding device.

* * * * *